US009207577B2

(12) United States Patent
Newman et al.

(10) Patent No.: US 9,207,577 B2
(45) **Date of Patent: *Dec. 8, 2015**

(54) TONER CARTRIDGE HAVING SHUTTER LOCK MECHANISM

(71) Applicant: Lexmark International, Inc., Lexington, KY (US)

(72) Inventors: Benjamin Keith Newman, Lexington, KY (US); Matthew Lee Rogers, Lexington, KY (US); Christopher Gene Vowels, Boston, KY (US)

(73) Assignee: Lexmark International, Inc., Lexington, KY (US)

( * ) Notice: Subject to any disclaimer, the term of this patent is extended or adjusted under 35 U.S.C. 154(b) by 0 days.

This patent is subject to a terminal disclaimer.

(21) Appl. No.: 14/571,396

(22) Filed: Dec. 16, 2014

(65) Prior Publication Data

US 2015/0098733 A1 Apr. 9, 2015

Related U.S. Application Data

(63) Continuation of application No. 13/340,876, filed on Dec. 30, 2011, now Pat. No. 8,948,650.

(51) Int. Cl.
*G03G 15/08* (2006.01)
*G03G 21/16* (2006.01)

(52) U.S. Cl.
CPC ..... *G03G 15/0886* (2013.01); *G03G 21/1676* (2013.01); *G03G 2215/067* (2013.01)

(58) Field of Classification Search
CPC ..... G03G 15/0886; G03G 21/1676; G03G 2215/067
See application file for complete search history.

(56) References Cited

U.S. PATENT DOCUMENTS

| | | | | |
|---|---|---|---|---|
| 5,842,093 | A | 11/1998 | Tanda | |
| 8,588,659 | B2 * | 11/2013 | Carter et al. | 399/258 |
| 8,682,213 | B2 * | 3/2014 | Carter et al. | 399/111 |
| 9,031,451 | B2 * | 5/2015 | Rulon et al. | 399/106 |

OTHER PUBLICATIONS

Notice of Allowance dated Feb. 6, 2015 for U.S. Appl. No. 13/780,042.

* cited by examiner

*Primary Examiner* — Rodney Bonnette
(74) *Attorney, Agent, or Firm* — Justin M Tromp

(57) ABSTRACT

A toner cartridge for use in an image forming device according to one example embodiment includes a housing having a reservoir for containing toner therein. The housing has an exit port in fluid communication with the reservoir. A shutter is positioned at the exit port that is movable between an open position and a closed position. The shutter is biased toward the closed position. A linkage is operatively connected to the shutter to open the shutter upon being actuated by a first engagement feature in the image forming device. An interlock is operatively engaged with the linkage and biased toward a locked position preventing the linkage from opening the shutter. The interlock is movable to an unlocked position that is disengaged with the linkage when the interlock is actuated by a second engagement feature in the image forming device permitting the linkage to open the shutter.

6 Claims, 14 Drawing Sheets

TONER CARTRIDGE HAVING SHUTTER LOCK MECHANISM

CROSS REFERENCES TO RELATED APPLICATIONS

This patent application is a continuation application of U.S. patent application Ser. No. 13/340,876, filed Dec. 30, 2011, entitled "Toner Cartridge having a Shutter Lock Mechanism." This patent application is also related to U.S. patent application Ser. No. 13/340,881, filed Dec. 30, 2011, entitled "Toner Cartridge having a Shutter Lock Mechanism", U.S. patent application Ser. No. 13/340,884, filed Dec. 30, 2011, entitled "Toner Cartridge having a Shutter Lock Mechanism", and U.S. patent application Ser. No. 13/340,935, filed Dec. 30, 2011, entitled "Toner Cartridge for Use in an Image Forming Device", all of which are assigned to the assignee of the present application.

BACKGROUND

1. Field of the Disclosure

The present disclosure relates generally to toner cartridges used in electrophotographic image forming devices and, more particularly, to a toner cartridge having a shutter lock mechanism.

2. Description of the Related Art

In order to reduce the premature replacement of components traditionally housed within a toner cartridge for an image forming device, toner cartridge manufacturers have begun to separate components having a longer life from those having a shorter life into separate replaceable units. Relatively longer life components such as a developer roll, a toner adder roll, a doctor blade and a photoconductive drum are positioned in one replaceable unit (an "imaging unit"). The image forming device's toner supply, which is consumed relatively quickly in comparison with the components housed in the imaging unit, is provided in a reservoir in a separate replaceable unit in the form of a toner cartridge that mates with the imaging unit. In this configuration, the number of components housed in the toner cartridge is reduced in comparison with traditional toner cartridges. As a result, in systems utilizing a separate toner cartridge and imaging unit, the toner cartridge is often referred to as a "toner bottle" even though the toner cartridge is more complex than a mere bottle for holding toner.

To deliver toner from the toner cartridge to the imaging unit, an auger in the toner cartridge may be used to feed toner from an exit port on the toner cartridge into an entrance port on the imaging unit and into a second auger that disperses the toner within the imaging unit. As the toner is drawn out of the toner cartridge, it is augured through a shutter used for sealing the exit port of the toner cartridge when it is not inserted in the printer. In order to prevent the undesired release of toner, the shutter preferably remains closed unless the toner cartridge is installed in the image forming device. Accordingly, the shutter may be biased toward the closed position. As the toner cartridge reaches its final position in the image forming device, a pin or other type of projection on the image forming device may engage a catch on the toner cartridge and supply an opposing force to open the shutter. For example, U.S. Pat. No. 7,606,520, entitled "Shutter for a Toner Cartridge for use with an Image Forming Device" and assigned to the assignee of the present invention provides an example shutter mechanism.

A problem may be experienced if a user accidentally releases toner from the cartridge by inadvertently actuating the shutter or by intentionally engaging the shutter catch without appreciating its purpose until it is too late. The released toner may fall from the toner cartridge and contact an area surrounding the image forming device or a user's clothing resulting in uncleanliness. Image forming devices having a separate toner cartridge and imaging unit present an additional concern. If the imaging unit is not present when the toner cartridge is installed in the image forming device and the cartridge's shutter is opened by the image forming device, any toner exiting the shutter will leak from the cartridge's exit port into the interior of the image forming device because the imaging unit is not there to receive it. When leaked toner falls into the internal portions of the image forming device, it can cause reliability issues and, in some cases, print defects. Accordingly, it will be appreciated that a mechanism that prevents the unwanted release of toner from the cartridge's shutter is desired.

SUMMARY

A toner cartridge for use in an image forming device according to one example embodiment includes a housing having a reservoir for containing toner therein. The housing has an exit port in fluid communication with the reservoir. A shutter is positioned at the exit port that is movable between an open position to permit toner from the reservoir to pass out of the exit port and a closed position to prevent toner from passing out of the exit port. The shutter is biased toward the closed position. A linkage is operatively connected to the shutter to open the shutter upon being actuated by a first engagement feature in the image forming device. An interlock is operatively engaged with the linkage and biased toward a locked position preventing the linkage from opening the shutter. The interlock is movable to an unlocked position that is disengaged with the linkage when the interlock is actuated by a second engagement feature in the image forming device permitting the linkage to open the shutter.

A toner cartridge for use in an image forming device having an imaging unit separate from the toner cartridge removably installed therein according to another example embodiment includes a housing having a reservoir for containing toner therein. The housing has an exit port in fluid communication with the reservoir. A shutter is positioned at the exit port that is movable between an open position to permit toner from the reservoir to pass out of the exit port and a closed position to prevent toner from passing out of the exit port. The shutter is biased toward the closed position. A linkage is operatively connected to the shutter to open the shutter upon being actuated by an engagement feature on the image forming device. An interlock is operatively engaged with the linkage and biased toward a locked position preventing the linkage from opening the shutter. The interlock is movable to an unlocked position that is disengaged with the linkage when the interlock is actuated by an engagement feature on the imaging unit permitting the linkage to open the shutter.

BRIEF DESCRIPTION OF THE DRAWINGS

The above-mentioned and other features and advantages of the various embodiments, and the manner of attaining them, will become more apparent and will be better understood by reference to the accompanying drawings.

DETAILED DESCRIPTION

Figure 1:
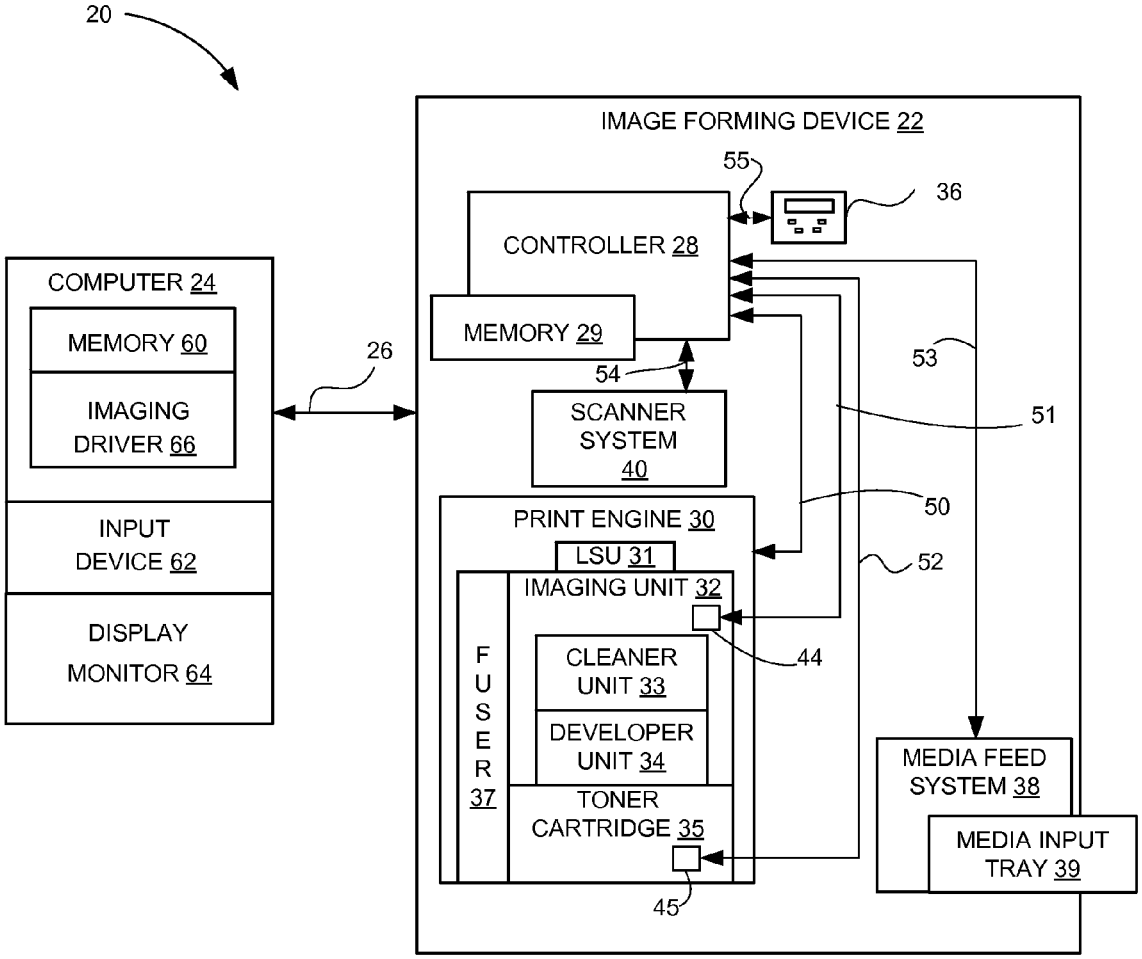
FIG. 1 is a block diagram of an imaging system according to one example embodiment.

The following description and drawings illustrate embodiments sufficiently to enable those skilled in the art to practice the present invention. It is to be understood that the disclosure is not limited to the details of construction and the arrangement of components set forth in the following description or illustrated in the drawings. The invention is capable of other embodiments and of being practiced or carried out in various ways. For example, other embodiments may incorporate structural, chronological, electrical, process, and other changes. Examples merely typify possible variations. Individual components and functions are optional unless explicitly required, and the sequence of operations may vary. Portions and features of some embodiments may be included in or substituted for those of others. The scope of the application encompasses the appended claims and all available equivalents. The following description is, therefore, not to be taken in a limited sense and the scope of the present invention is defined by the appended claims.

Also, it is to be understood that the phraseology and terminology used herein is for the purpose of description and should not be regarded as limiting. The use of "including," "comprising," or "having" and variations thereof herein is meant to encompass the items listed thereafter and equivalents thereof as well as additional items. Unless limited otherwise, the terms "connected," "coupled," and "mounted," and variations thereof herein are used broadly and encompass direct and indirect connections, couplings, and mountings. In addition, the terms "connected" and "coupled" and variations thereof are not restricted to physical or mechanical connections or couplings.

Spatially relative terms such as "top", "bottom", "front", "back", "rear" and "side" "under", "below", "lower", "over", "upper", and the like, are used for ease of description to explain the positioning of one element relative to a second element. These terms are generally used in reference to the position of an element in its intended working position within an image forming device. Further, terms such as "first", "second", and the like, are used to describe various elements, regions, sections, etc. and are not intended to be limiting. The term "image" as used herein encompasses any printed or digital form of text, graphic, or combination thereof. Like terms refer to like elements throughout the description.

Referring now to the drawings and particularly to FIG. 1, there is shown a block diagram depiction of an imaging system 20 according to one example embodiment. Imaging system 20 includes an image forming device 22 and a computer 24. Image forming device 22 communicates with computer 24 via a communications link 26. As used herein, the term "communications link" generally refers to any structure that facilitates electronic communication between multiple components and may operate using wired or wireless technology and may include communications over the Internet.

In the example embodiment shown in FIG. 1, image forming device 22 is a multifunction machine (sometimes referred to as an all-in-one (AIO) device) that includes a controller 28, a print engine 30, a laser scan unit (LSU) 31, an imaging unit 32, a toner cartridge 35, a user interface 36, a media feed system 38, a media input tray 39 and a scanner system 40. Image forming device 22 may communicate with computer 24 via a standard communication protocol, such as for example, universal serial bus (USB), Ethernet or IEEE 802.xx. Image forming device 22 may be, for example, an electrophotographic printer/copier including an integrated scanner system 40 or a standalone electrophotographic printer.

Controller 28 includes a processor unit and associated memory 29 and may be formed as one or more Application Specific Integrated Circuits (ASICs). Memory 29 may be any volatile or non-volatile memory of combination thereof such as, for example, random access memory (RAM), read only memory (ROM), flash memory and/or non-volatile RAM (NVRAM). Alternatively, memory 29 may be in the form of a separate electronic memory (e.g., RAM, ROM, and/or NVRAM), a hard drive, a CD or DVD drive, or any memory device convenient for use with controller 28. Controller 28 may be, for example, a combined printer and scanner controller.

In the example embodiment illustrated, controller 28 communicates with print engine 30 via a communications link 50. Controller 28 communicates with imaging unit 32 and processing circuitry 44 thereon via a communications link 51. Controller 28 communicates with toner cartridge 35 and processing circuitry 45 therein via a communications link 52. Controller 28 communicates with media feed system 38 via a communications link 53. Controller 28 communicates with scanner system 40 via a communications link 54. User interface 36 is communicatively coupled to controller 28 via a communications link 55. Processing circuitry 44, 45 may provide authentication functions, safety and operational interlocks, operating parameters and usage information related to imaging unit 32 and toner cartridge 35, respectively. Controller 28 processes print and scan data and operates print engine 30 during printing and scanner system 40 during scanning.

Computer 24, which is optional, may be, for example, a personal computer, including memory 60, such as RAM, ROM, and/or NVRAM, an input device 62, such as a keyboard and/or a mouse, and a display monitor 64. Computer 24 also includes a processor, input/output (I/O) interfaces, and may include at least one mass data storage device, such as a hard drive, a CD-ROM and/or a DVD unit (not shown). Computer 24 may also be a device capable of communicating with image forming device 22 other than a personal computer such as, for example, a tablet computer, a smartphone, or other electronic device.

In the example embodiment illustrated, computer 24 includes in its memory a software program including program instructions that function as an imaging driver 66, e.g., printer/scanner driver software, for image forming device 22. Imaging driver 66 is in communication with controller 28 of image forming device 22 via communications link 26. Imaging driver 66 facilitates communication between image forming device 22 and computer 24. One aspect of imaging driver 66 may be, for example, to provide formatted print data to image forming device 22, and more particularly to print engine 30, to print an image. Another aspect of imaging driver 66 may be, for example, to facilitate collection of scanned data from scanner system 40.

In some circumstances, it may be desirable to operate image forming device 22 in a standalone mode. In the standalone mode, image forming device 22 is capable of functioning without computer 24. Accordingly, all or a portion of imaging driver 66, or a similar driver, may be located in controller 28 of image forming device 22 so as to accommodate printing and/or scanning functionality when operating in the standalone mode.

Print engine 30 includes laser scan unit (LSU) 31, toner cartridge 35, imaging unit 32, and fuser 37, all mounted within image forming device 22. Imaging unit 32 is removably mounted in image forming device 22 and includes a developer unit 34 that houses a toner sump and a toner delivery system. The toner delivery system includes a toner adder roll that provides toner from the toner sump to a developer roll. A doctor blade provides a metered uniform layer of toner on the surface of the developer roll. Imaging unit 32 also includes a cleaner unit 33 that houses a photoconductive drum and a waste toner removal system. Toner cartridge 35 is also removably mounted in imaging unit 32 in a mating relationship with developer unit 34 of imaging unit 32. An exit port on toner cartridge 35 communicates with an entrance port on developer unit 34 allowing toner to be periodically transferred from toner cartridge 35 to resupply the toner sump in developer unit 34.

The electrophotographic printing process is well known in the art and, therefore, is described briefly herein. During a printing operation, laser scan unit 31 creates a latent image on the photoconductive drum in cleaner unit 33. Toner is transferred from the toner sump in developer unit 34 to the latent image on the photoconductive drum by the developer roll to create a toned image. The toned image is then transferred to a media sheet received in imaging unit 32 from media input tray 39 for printing. Toner remnants are removed from the photoconductive drum by the waste toner removal system. The toner image is bonded to the media sheet in fuser 37 and then sent to an output location or to one or more finishing options such as a duplexer, a stapler or a hole-punch.

Figure 2:
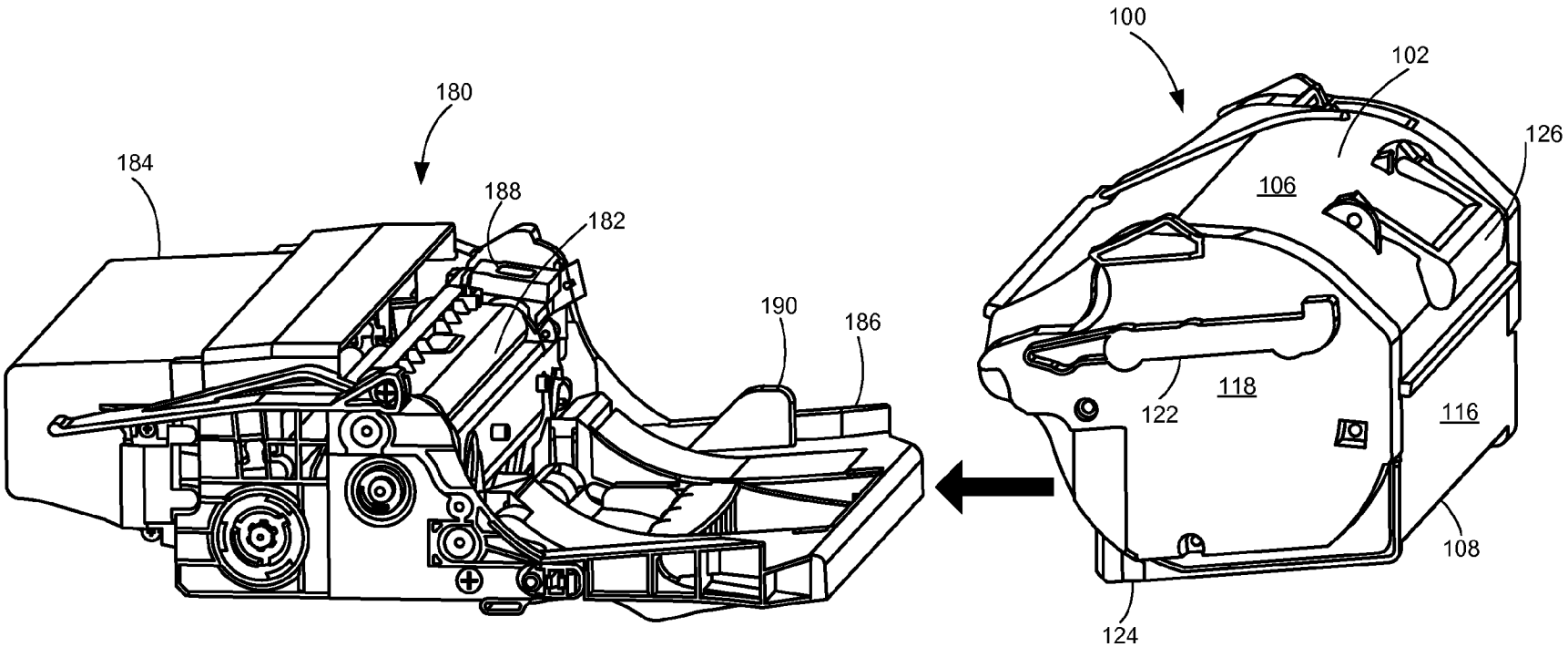
FIG. 2 is a perspective view of a toner cartridge and an imaging unit according to one example embodiment.
Figure 3:
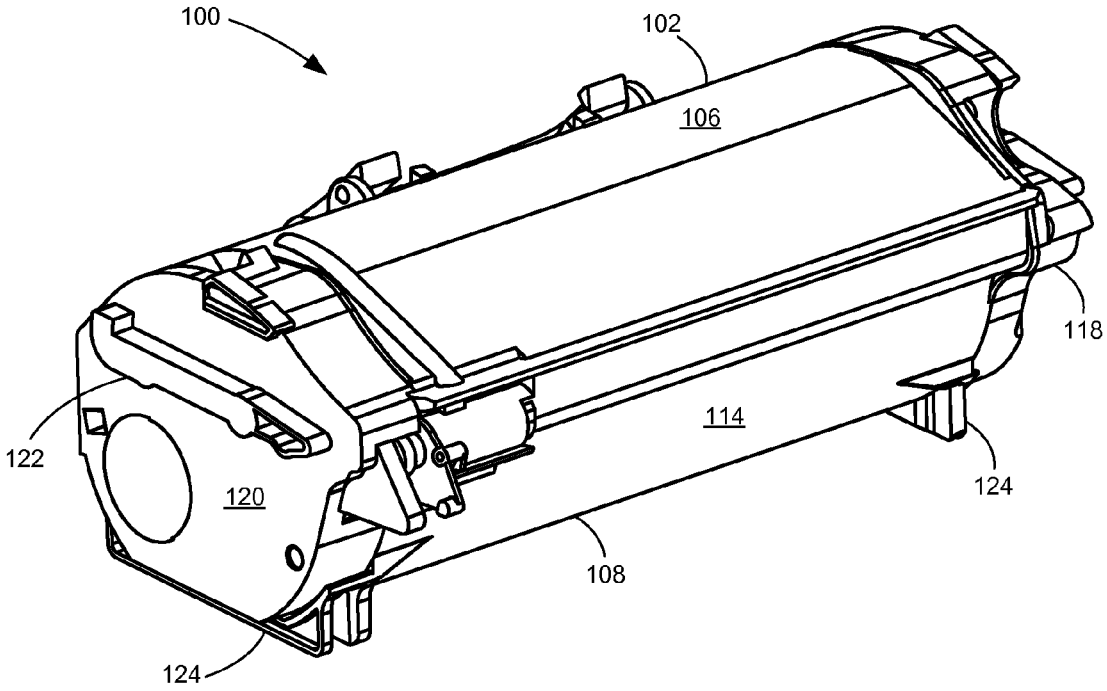
FIGS. 3 and 4 are additional perspective views of the toner cartridge shown in FIG. 2.
Figure 4:
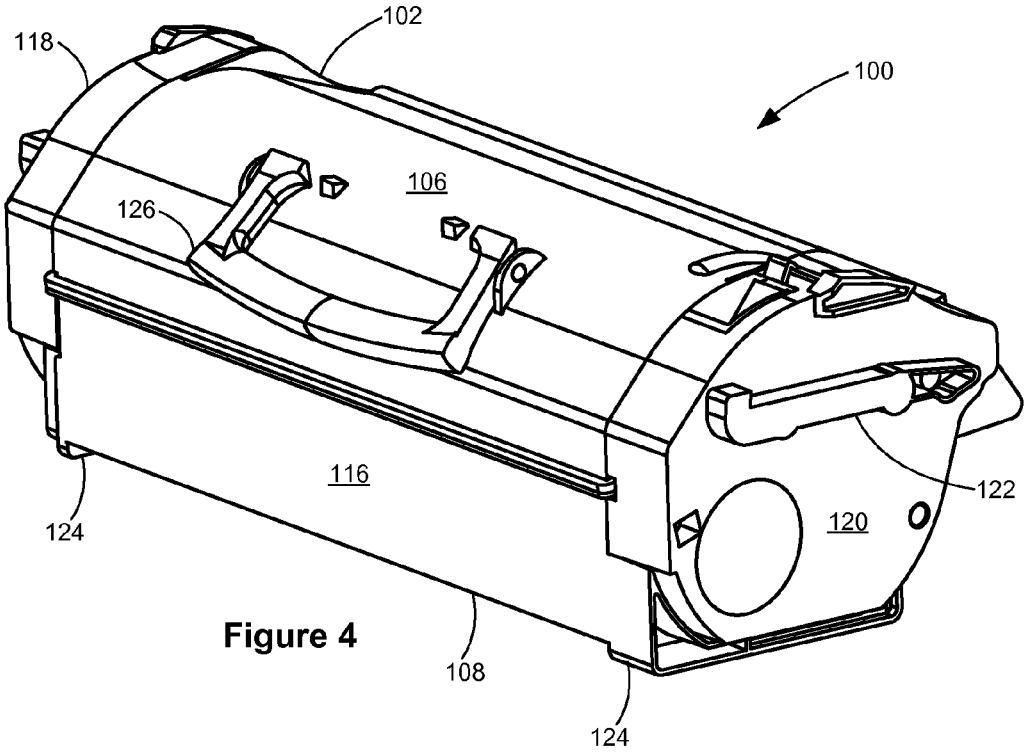

Referring now to FIG. 2, a toner cartridge 100 and an imaging unit 180 are shown according to one example embodiment. Imaging unit 180 includes a developer unit 182 and a cleaner unit 184 mounted on a common frame 186. As discussed above, imaging unit 180 and toner cartridge 100 are each removably installed in image forming device 22. Imaging unit 180 is first slidably inserted into image forming device 22. Toner cartridge 100 is then inserted into image forming device 22 and onto frame 186 in a mating relationship with developer unit 182 of imaging unit 180 as indicated by the arrow shown in FIG. 2. This arrangement allows toner cartridge 100 to be removed and reinserted easily when replacing an empty toner cartridge without having to remove imaging unit 180. Imaging unit 180 may also be readily removed as desired in order to maintain, repair or replace the components associated with developer unit 182, cleaning unit 184 or frame 186 or to clear a media jam.

With reference to FIGS. 2-5, toner cartridge 100 includes a housing 102 having an enclosed reservoir 104 (FIG. 5) for holding a quantity of toner therein. Housing 102 may be viewed as having a top or lid 106 mounted on a base 108. Base 108 includes first and second side walls 110, 112 connected to adjoining front and rear walls 114, 116. In one embodiment, top 106 is ultrasonically welded to base 108 thereby forming enclosed reservoir 104. First and second end caps 118, 120 are mounted to side walls 110, 112, respectively, and include guides 122 to assist the insertion of toner cartridge 100 into image forming device 22 for mating with developer unit 182. First and second end caps 118, 120 may be snap fitted into place or attached by screws or other fasteners. Guides 122 travel in corresponding channels within image forming device 22. Legs 124 may also be provided on a bottom portion of base 106 or end caps 118, 120 to assist with the insertion of toner cartridge 100 into image forming device 22. Legs 124 are received by a corresponding slot or channel in frame 186 to facilitate the mating of toner cartridge 100 with developer unit 182. A handle 126 may be provided on top 106 or base 108 of toner cartridge 100 to assist with insertion and removal of toner cartridge 100 from imaging unit 180 and image forming device 22. As shown in FIG. 6, a fill port 128 is provided on side wall 112 that is used to fill toner cartridge 100 with toner. After filling, fill port 128 is closed by a plug 130 and/or cap 132.

Figure 5:
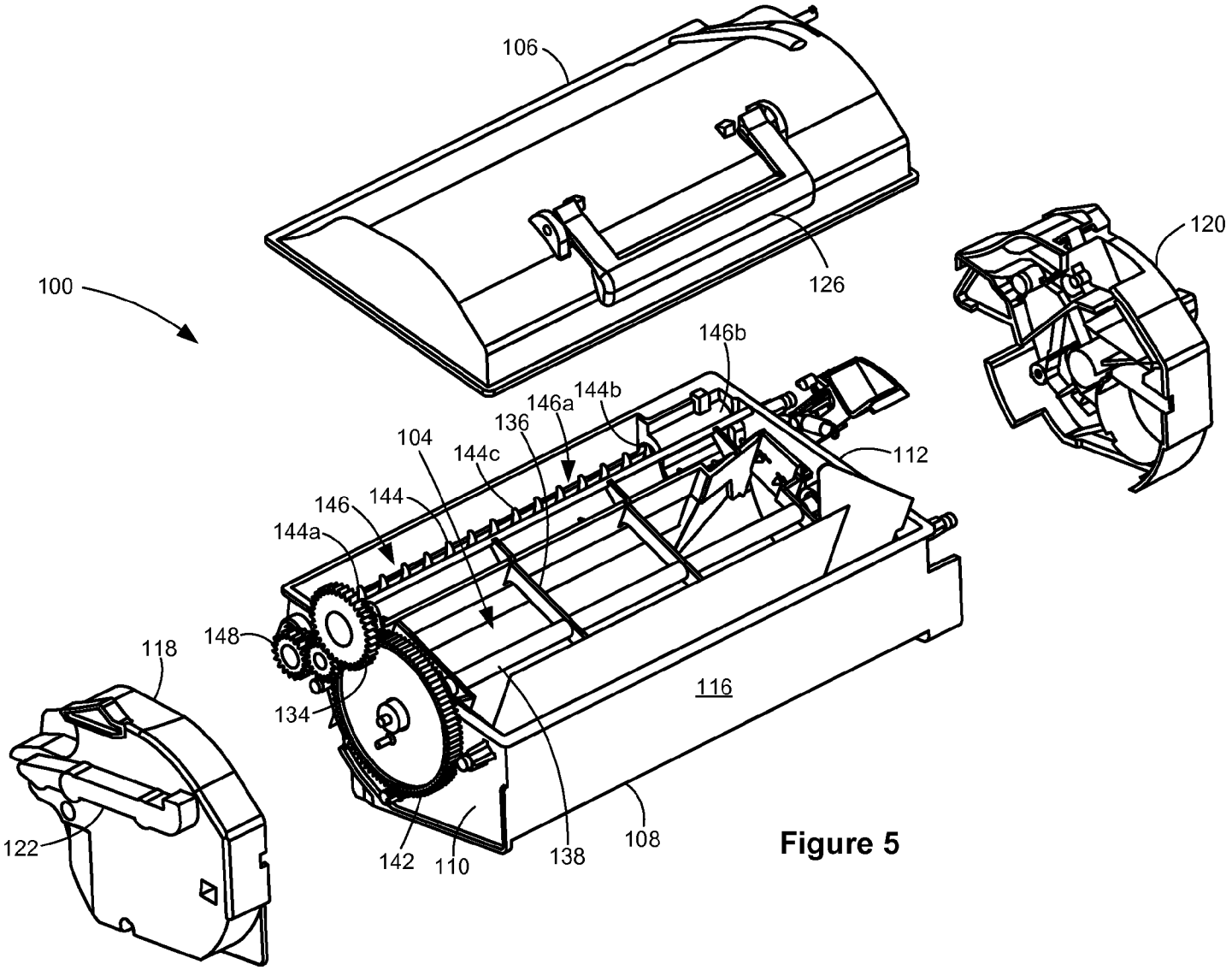
FIGS. 5 and 6 are exploded views of the toner cartridge shown in FIG. 2 showing a reservoir for holding toner therein.
Figure 6:
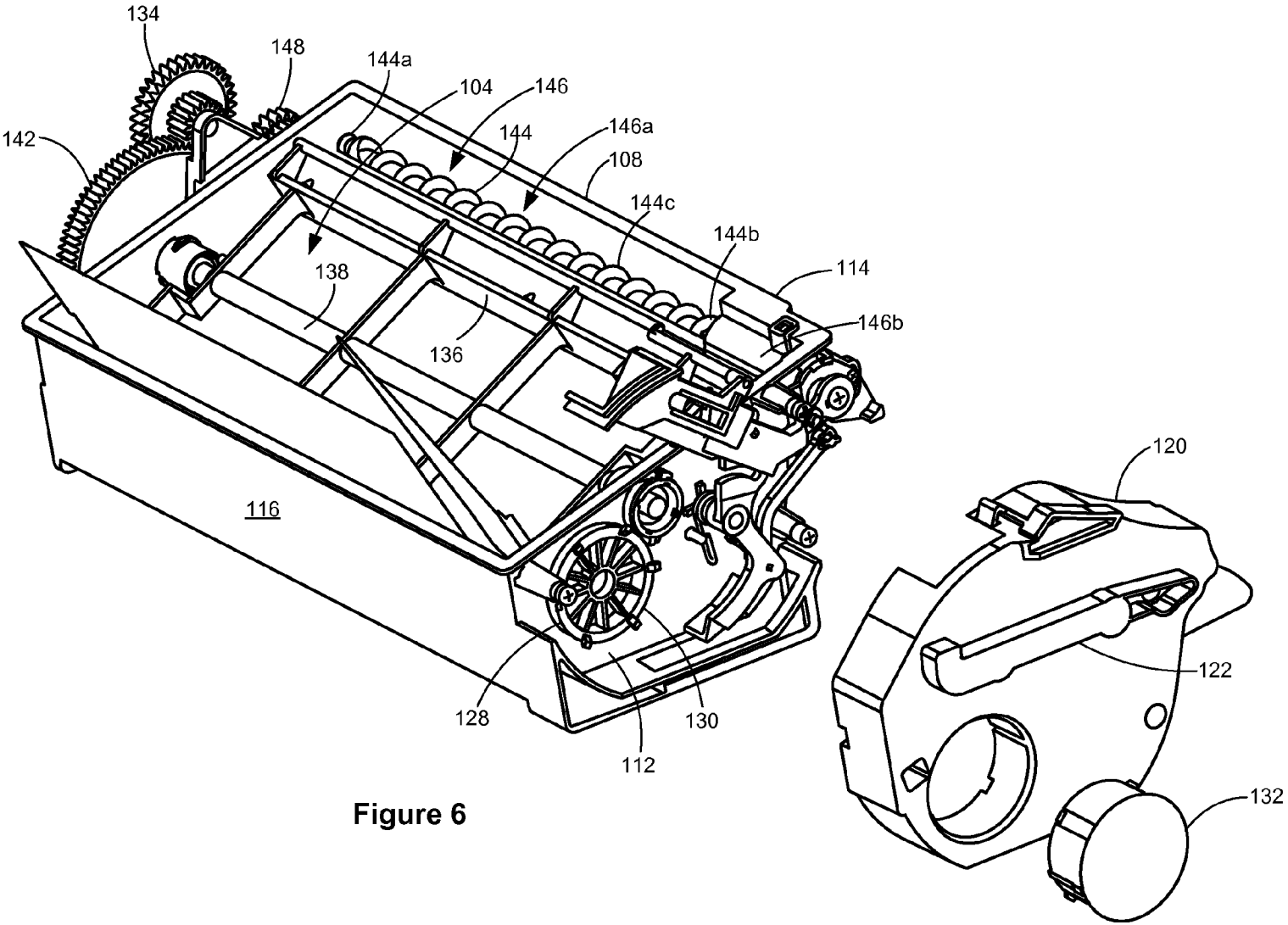

With reference to FIG. 5, various drive gears are housed within a space formed between end cap 118 and side wall 110. A main interface gear 134 engages with a drive system in image forming device 22 that provides torque to main interface gear 134. As discussed in greater detail below, various linkages are housed within a space formed between end cap 120 and side wall 112. One or more paddles 136 are rotatably mounted within toner reservoir 104 with first and second ends of a drive shaft 138 of paddle(s) 136 extending through aligned openings in side walls 110, 112, respectively. A drive gear 142 is provided on the first end of drive shaft 138 that engages with main interface gear 134 either directly or via one or more intermediate gears. Bushings may be provided on each end of drive shaft 138 where it passes through side walls 110, 112. Accordingly, side wall 110 may also be termed the "drive" or "driven" side of toner cartridge 100.

With reference to FIGS. 5 and 6, an auger 144 having first and second ends 144*a*, 144*b*, and a spiral screw flight 144*c* is positioned in a channel 146 extending along the width of front wall 114 between side walls 110, 112. Channel 146 may be integrally molded as part of front wall 114 or formed as a separate component that is attached to front wall 114. Channel 146 is generally horizontal in orientation along with toner cartridge 100 when toner cartridge 100 is installed in image forming device 22. First end 144*a* of auger 144 extends through side wall 110 and a drive gear 148 is provided on first end 144*a* that engages with main interface gear 134 either directly or via one or more intermediate gears. Channel 146 includes an open portion 146*a* and an enclosed portion 146*b*. Open portion 146*a* is open to toner reservoir 104 and extends from side wall 110 toward second end 144*b* of auger 144. Enclosed portion 146*b* of channel 146 extends from side wall 112 and encloses a shutter assembly 150 (FIG. 7) and second end 144*b* of auger 144. As paddle(s) 136 rotate, they deliver toner from toner reservoir 104 into open portion 146*a* of channel 146. Auger 144 is rotated via drive gear 148 to deliver toner received in channel 146 to shutter assembly 150. Shutter assembly 150 regulates whether toner is permitted to exit toner cartridge 100 through an exit port 152 provided in front wall 114 and shown in FIG. 7. In this embodiment, exit port 152 is disposed at the bottom of channel 146 so that gravity will assist in exiting toner through exit port 152.

Shutter assembly 150 is shown in more detail in FIGS. 8A, 8B, 9A and 9B. Shutter assembly 150 includes a shutter 154 that is rotatable between a closed position shown in FIGS. 8A and 9A and an open position shown in FIGS. 8B and 9B. Shutter 154 includes an open end 154*a* that receives second end 144*b* of auger 144 therein. As auger 144 rotates, it delivers toner from channel 146 to shutter 154. Shutter 154 includes a radial opening 154*b* that is connected to open end 154*a* by an internal channel in shutter 154. Radial opening 154*b* permits toner to exit toner cartridge 100 through exit port 152 as discussed in greater detail below.

Figure 7:
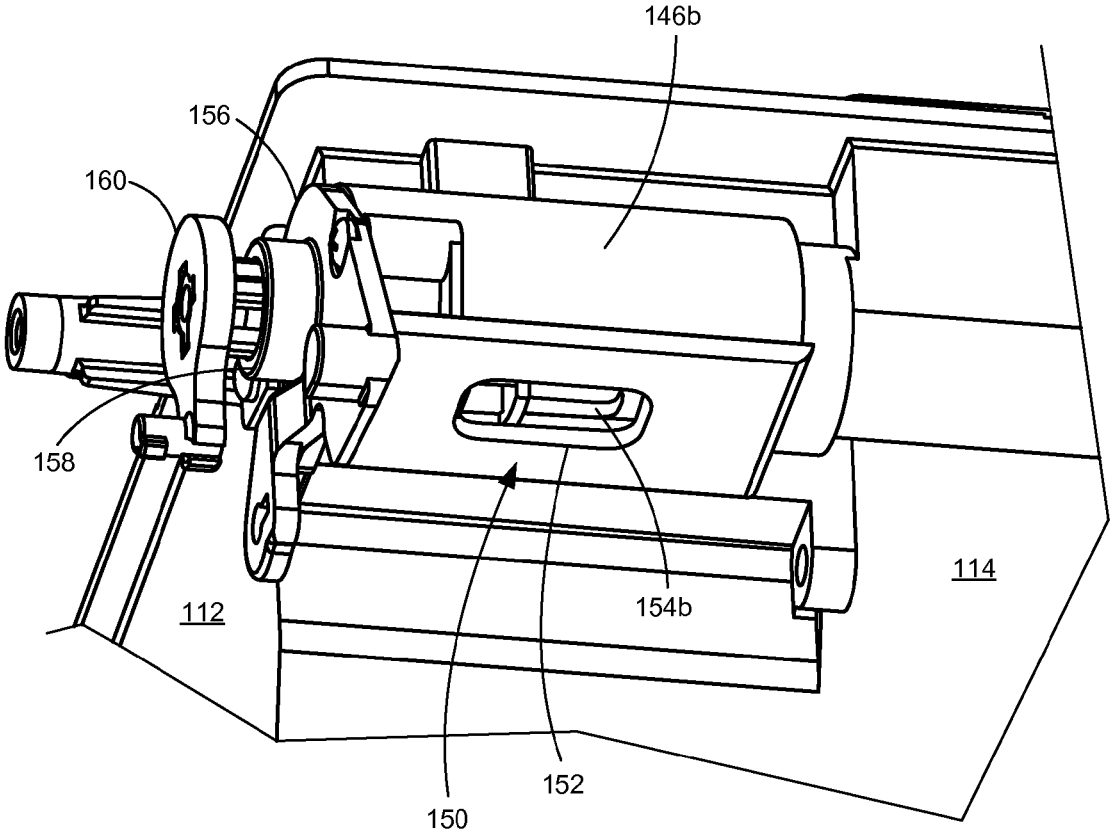
FIG. 7 is a perspective view of a front portion of the toner cartridge shown in FIG. 2 showing an exit port thereof.

A retaining member 156 is mounted on side wall 112 of toner cartridge 100 (FIG. 7). In the example embodiment illustrated, retaining member 156 is a separate component attached to housing 102; however, retaining member 156 may also be integrally molded as part of housing 102. Retaining member 156 includes a bushing 158 that receives a closed end 154*c* of shutter 154. Closed end 154*c* of shutter 154 is connected to a lever 160 that opens and closes shutter 154. In the example embodiment illustrated, closed end 154*c* of shutter 154 includes a key 162 and lever 160 includes a corresponding keyway 164. Key 162 and keyway 164 couple shutter 154 to lever 160 such that the rotation of lever 160 opens and closes shutter 154. It will be appreciated that this configuration may be reversed so that lever 160 includes a key and closed end 154*c* includes a corresponding keyway. In the embodiment illustrated, lever 160 is connected to closed end 154*c* via a fastener 166 that passes through keyway 164 and a threaded hole 168 in closed end 154*c*; however, lever 160 and shutter 154 may be connected by any suitable means such as by being snap fit together. A post 170 is provided on the distal end of lever 160.

Figure 8A:
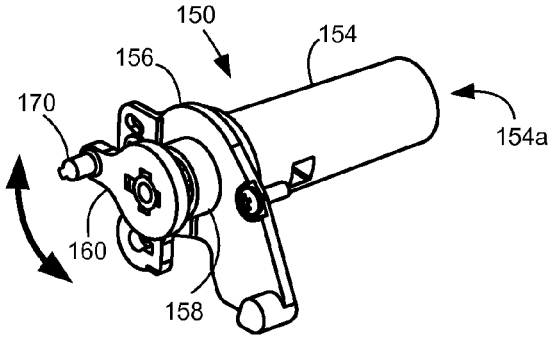
FIGS. 8A and 8B are perspective views of a shutter assembly for use with the toner cartridge in a closed position and an open position, respectively, according to one example embodiment.
Figure 8B:
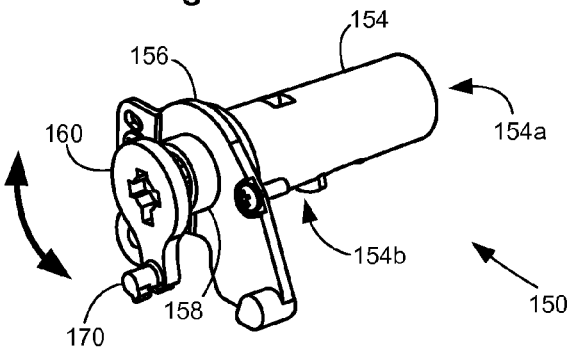
Figure 9A:
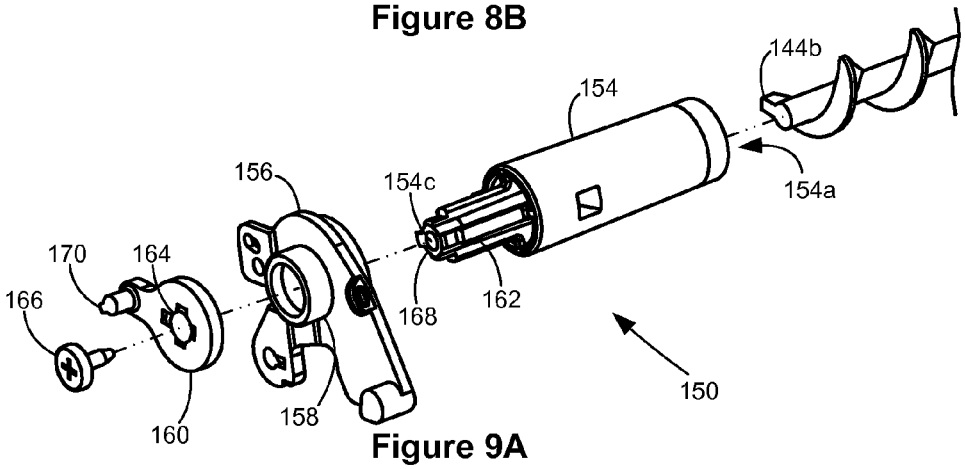
FIGS. 9A and 9B are exploded views of the shutter assembly shown in FIGS. 8A and 8B.
Figure 9B:
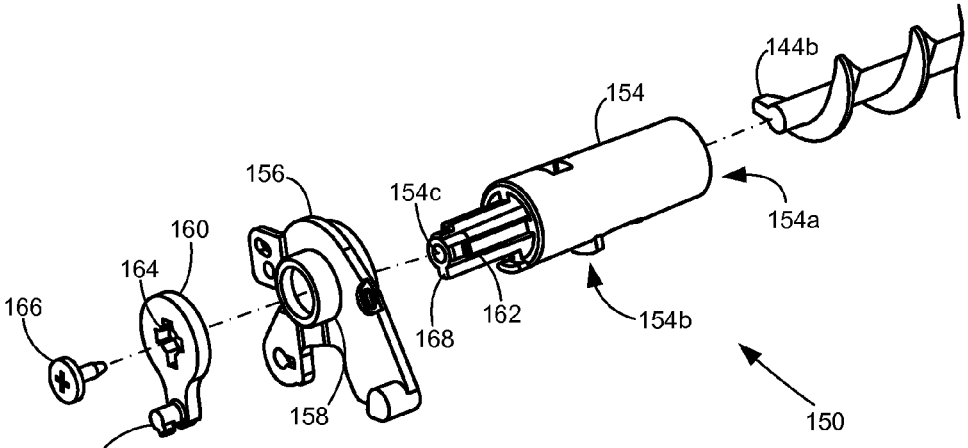

When lever 160 is in a first position shown in FIGS. 8A and 9A, shutter 154 is in a closed position with radial opening 154*b* positioned against an internal surface of enclosed portion 146*b* of channel 146 in order to prevent toner from exiting toner cartridge 100. When lever 160 rotates to a second position shown in FIGS. 8B and 9B, shutter 154 rotates to an open position where radial opening 154*b* is aligned with exit port 152 to permit toner to exit toner cartridge 100. When shutter 154 is in the open position, toner may be delivered from reservoir 104 of toner cartridge 100 to imaging unit 180 by rotating paddle(s) 136 and auger 144 as desired. Specifically, as paddle(s) 136 rotate, they deliver toner from toner reservoir 104 into open portion 146*a* of channel 146. As auger 144 rotates, it delivers toner received in channel 146 to shutter 154 through open end 154*a*. Toner passes through the internal channel in shutter 154 and out of radial opening 154*b* and exit port 152 into a corresponding entrance port 188 in developer unit 182 (FIG. 2).

Figure 10:
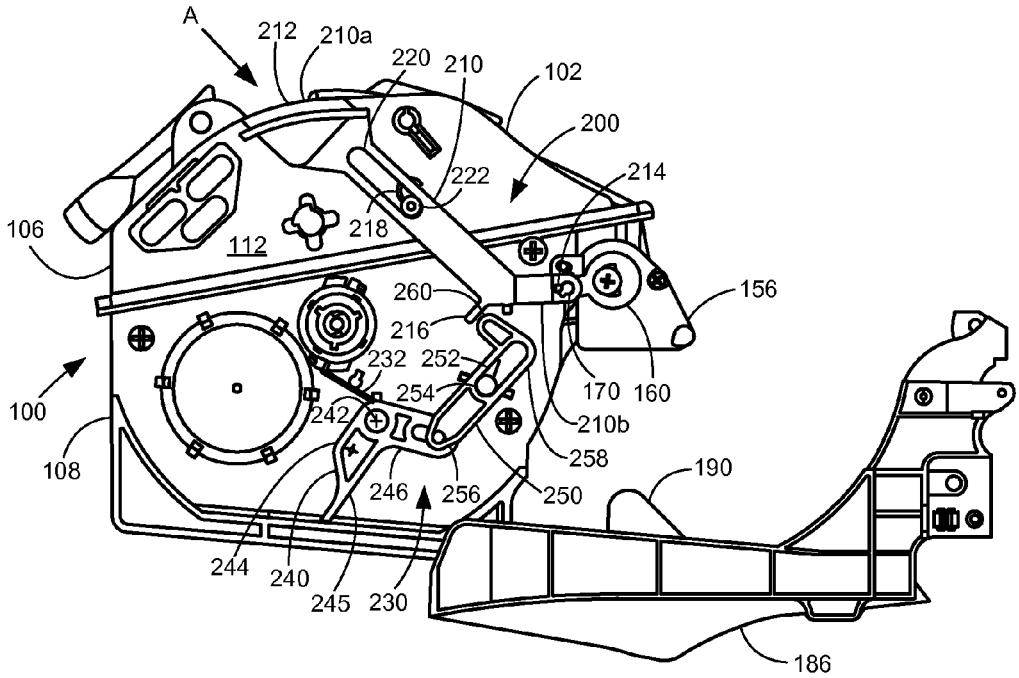
FIG. 10 is a side elevation view of a toner cartridge with an end cap removed to show a shutter lock mechanism in a locked position with a shutter closed according to a first example embodiment.

FIG. 10 shows a side view of cartridge 100 with end cap 120 removed to more clearly illustrate a shutter lock mechanism 200 housed between side wall 112 and end cap 120. Lock mechanism 200 includes a shutter linkage 210 that actuates lever 160 to open and close shutter 154. Lock mechanism 200 also includes an interlock 230 that prevents shutter 154 from being opened unless toner cartridge 100 is installed within image forming device 22 and, more specifically, unless toner cartridge 100 is mated with imaging unit 180. At one end 210*a*, shutter linkage 210 includes an engagement surface 212, such as a button-like area, that is exposed to an exterior portion of housing 102, such as a rear portion of end cap 120 next to lid 106 as shown. Shutter linkage 210 is connected at its opposite end 210*b* to lever 160. In the example embodiment illustrated, end 210*b* of shutter linkage 210 includes a channel 214 that receives post 170 extending from lever 160. However, shutter linkage 210 and lever 160 may be connected by any suitable means such as, for example, by reversing the post/channel configuration such that shutter linkage 210 includes a post and lever 160 includes a corresponding channel. Shutter linkage 210 is an elongated member that extends from end 210*a* having engagement surface 212 to end 210*b* that is connected to lever 160. Shutter linkage 210 also includes a catch 216 extending therefrom that engages with interlock 230 when interlock 230 is in the locked position as described in greater detail below.

Shutter linkage 210 is biased by a biasing member, such as, for example an extension spring 218 (partially hidden by shutter linkage 210), toward the exterior portion of housing 102 where end 210*a* is exposed, i.e., the position shown in FIG. 10, to close shutter 154. It will be appreciated that one or more biasing members may be provided at any suitable location(s) in shutter linkage 210 as desired. Shutter linkage 210 is translatable in the direction shown by arrow A in FIG. 10 when engagement surface 212 is depressed and the biasing force is overcome. As shutter linkage 210 translates in the direction indicated by arrow A, lever 160 rotates opening shutter 154. Shutter linkage 210 includes an elongated slot 220 that receives a corresponding post 222 on end cap 120 or side wall 112. Slot 220 and post 222 define the path of movement of shutter linkage 210.

Figure 11:
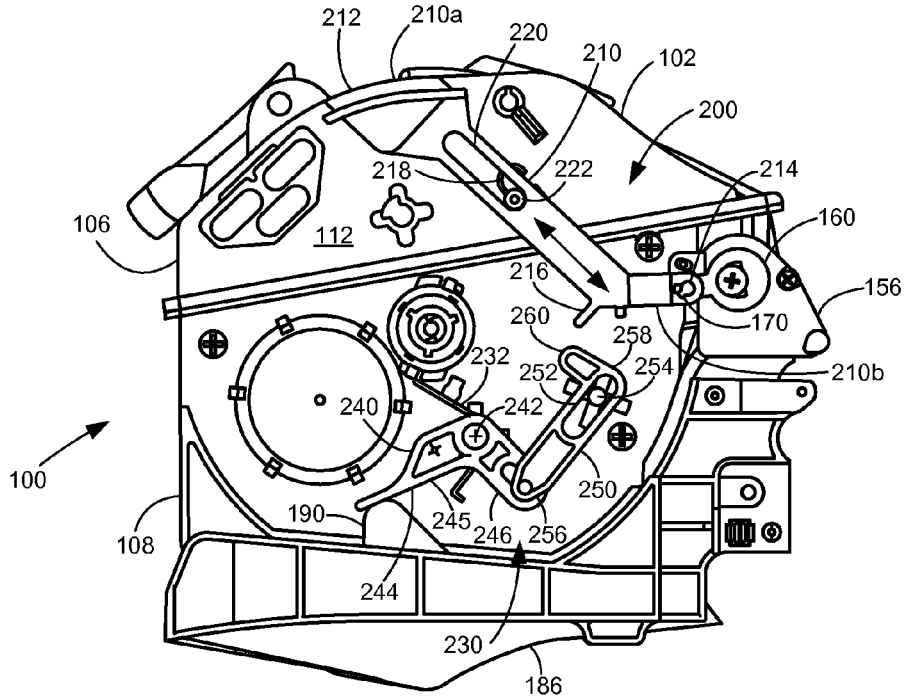
FIG. 11 is a side elevation view of the toner cartridge shown in FIG. 10 showing the shutter lock mechanism in an unlocked position with the shutter closed.
Figure 12:
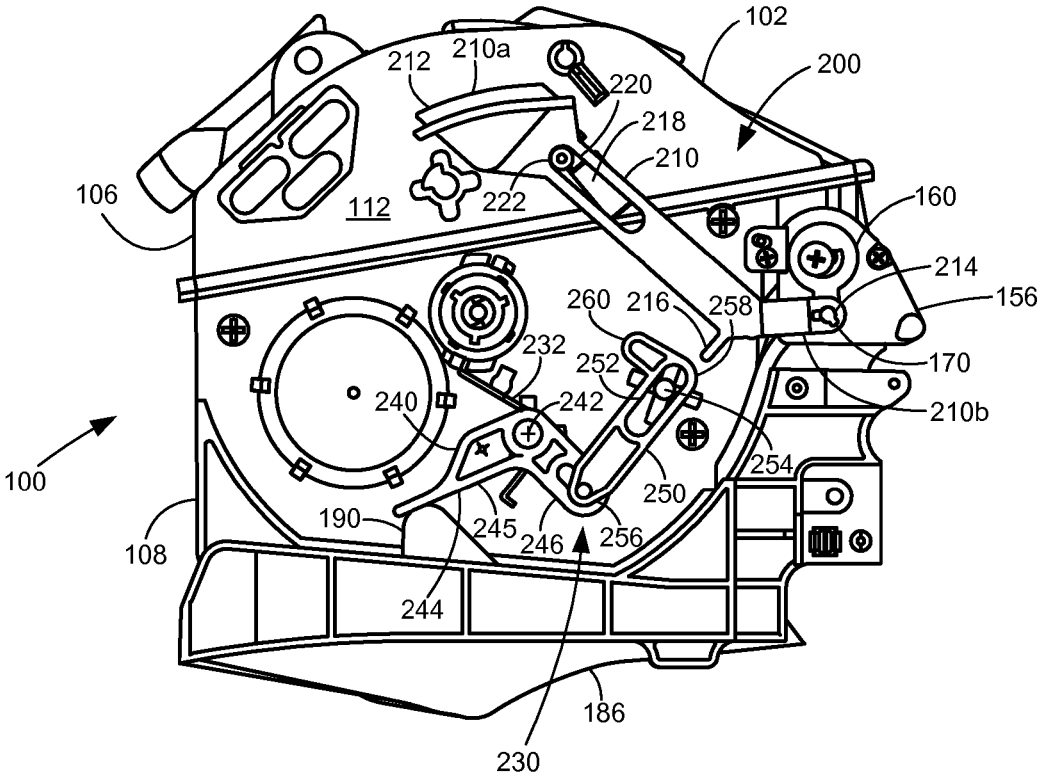
FIG. 12 is a side elevation view of the toner cartridge shown in FIGS. 10 and 11 showing the shutter lock mechanism in the unlocked position with the shutter opened.

Interlock 230 is movable between a locked position shown in FIG. 10 and an unlocked position shown in FIGS. 11 and 12. In the locked position, interlock 230 prevents shutter 154 from opening by restricting the movement of shutter linkage 210. In the unlocked position, interlock 230 permits shutter 154 to open and close freely by clearing away from shutter linkage 210. With continued reference to FIGS. 10-12, in the example embodiment illustrated, interlock 230 includes a rotatable member 240 and a translatable member 250. Rotatable member 240 is pivotally mounted on side wall 112 at an axis of rotation 242 and includes a first leg 244 and a second leg 246. Translatable member 250 is slidably mounted on side wall 112 to permit translational back-and-forth motion. For example, in the embodiment illustrated, translatable member 250 includes an elongated slot 252 that receives a corresponding post 254 on side wall 112 or end cap 120. Slot 252 and post 254 limit the travel of translatable member 250 and define its path of movement. A first end 256 of translatable member 250 is connected to second leg 246 of rotatable member 240. In this manner, rotation of rotatable member 240 about axis of rotation 242 causes translatable member 250 to slide according to the engagement between slot 252 and post 254. A second end 258 of translatable member 250 includes a knob 260 thereon that engages with catch 216 of shutter linkage 210 when interlock 230 is in the locked position to prevent shutter linkage 210 from opening shutter 154. Interlock 230 is biased by one or more biasing members in the locked position to prevent shutter 154 from opening prior to installation of toner cartridge 100 in image forming device 22. For example, in the embodiment shown, a torsion spring 232 positioned at axis of rotation 242 biases rotatable member 240 to the locked position. Alternatively, an extension spring may be used as discussed above with respect to shutter linkage 210 to bias translatable member 250 to the locked position. However, it will be appreciated that one or more biasing members may be provided at any suitable location(s) in interlock 230 as desired. An engagement surface 245 is provided on first leg 244 for contacting an engagement feature on imaging unit 180 to unlock interlock 230 as discussed in greater detail below.

Figure 13:
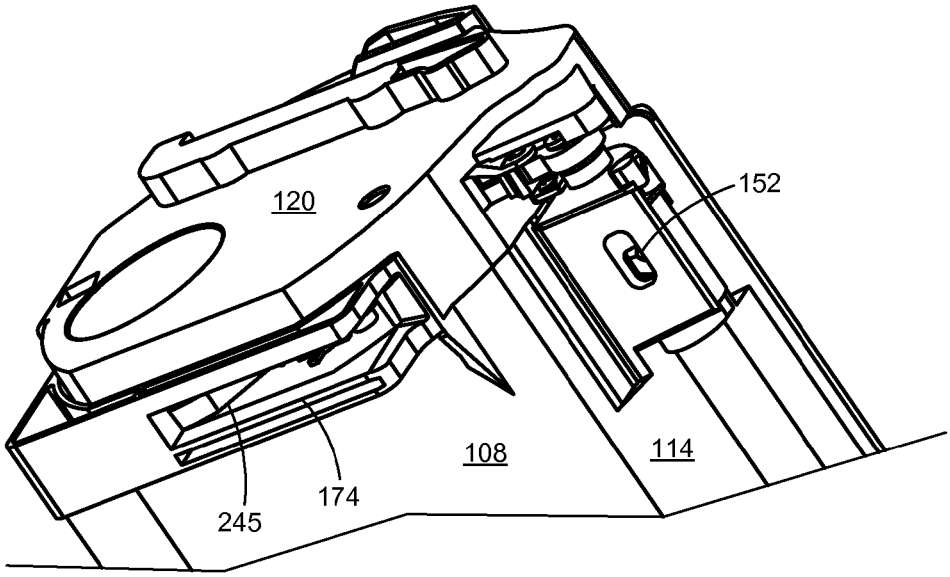
FIG. 13 is a perspective view of the toner cartridge shown FIGS. 10-12 showing a slot in a front portion of the toner cartridge for receiving an engagement feature to actuate the lock according to one example embodiment.

Shutter linkage 210 and interlock 230 prevent shutter 154 from being opened unless engagement surface 212 of shutter linkage 210 is depressed and engagement surface 245 of interlock 230 is engaged. This prevents shutter 154 from opening unless toner cartridge 100 is mated with imaging unit 180 in its final position in image forming device 22. In use, imaging unit 180 is removably inserted in image forming device 22 prior to inserting toner cartridge 100. Toner cartridge 100 is then inserted into image forming device 22 and onto frame 186 in a mated relationship with imaging unit 180. As toner cartridge advances toward its final position in image forming device 22, mated with imaging unit 180, fin 190 on frame 186 (or another engagement feature on imaging unit 180) is received in a slot 174 (see FIG. 13) provided in a front portion of base 108 and/or end cap 120 of toner cartridge 100. Slot 174 limits the access to interlock 230 to reduce the likelihood that a user will inadvertently unlock interlock 230. As toner cartridge 100 advances, fin 190 contacts engagement surface 245 of rotatable member 240. The force from fin 190 on rotatable member 240 overcomes the biasing force applied by spring 232 and causes rotatable member 240 to rotate in a clockwise direction (as viewed in FIGS. 10-12). This, in turn, pulls translatable member 250 away from shutter linkage 210 as shown in FIG. 11 and pulls knob 260 clear of catch 216 thereby unlocking or disengaging interlock 230. After toner cartridge 100 is inserted into image forming device 22, when an access door to image forming device 22 is closed, a plunger or other form of projection extending from an inner surface of the access door (or otherwise linked to the access door) presses engagement surface 212 overcoming the biasing force applied by spring 218 and depressing shutter linkage 210 causing shutter linkage 210 to translate. This causes lever 160 to rotate to open shutter 154 as shown in FIG. 12. In this manner, assembly 200 ensures that shutter 154 remains closed unless toner cartridge 100 is installed in image forming device 22 and mated with imaging unit 180.

When toner cartridge 100 is removed from image forming device 22, this sequence is reversed. When the access door to image forming device 22 is opened, extension spring 218 retracts shutter linkage 210 to its biased position, closing shutter 154. As the user removes toner cartridge 100 from the device, fin 190 disengages from engagement surface 245 causing interlock 230 to return to the locked position to ensure that shutter 154 remains closed while toner cartridge 100 is removed from image forming device 22.

If toner cartridge 100 is installed in image forming device 22 without imaging unit 180, interlock 230 will remain locked preventing shutter 154 from opening. Specifically, when engagement surface 212 is pressed, knob 260 will contact catch 216 on shutter linkage 210 and impede the translative motion of shutter linkage 210. If shutter 154 was opened without imaging unit 180 present, toner would be able to escape toner cartridge 100 through exit port 152 into the internal area of image forming device 22 potentially causing print defects. Interlock 230 prevents this from happening. Further, prior to insertion of toner cartridge 100 in image forming device 22, users may be tempted to press engagement surface 212 without realizing its function. Interlock 230 prevents a user from accidently opening shutter 154 when toner cartridge is not installed in image forming device 22. Similarly, when toner cartridge 100 is inserted into image forming device 22 and mated with imaging unit 180, shutter 154 will remain closed until the access door is closed indicating that the device is ready to print.

Figure 14:
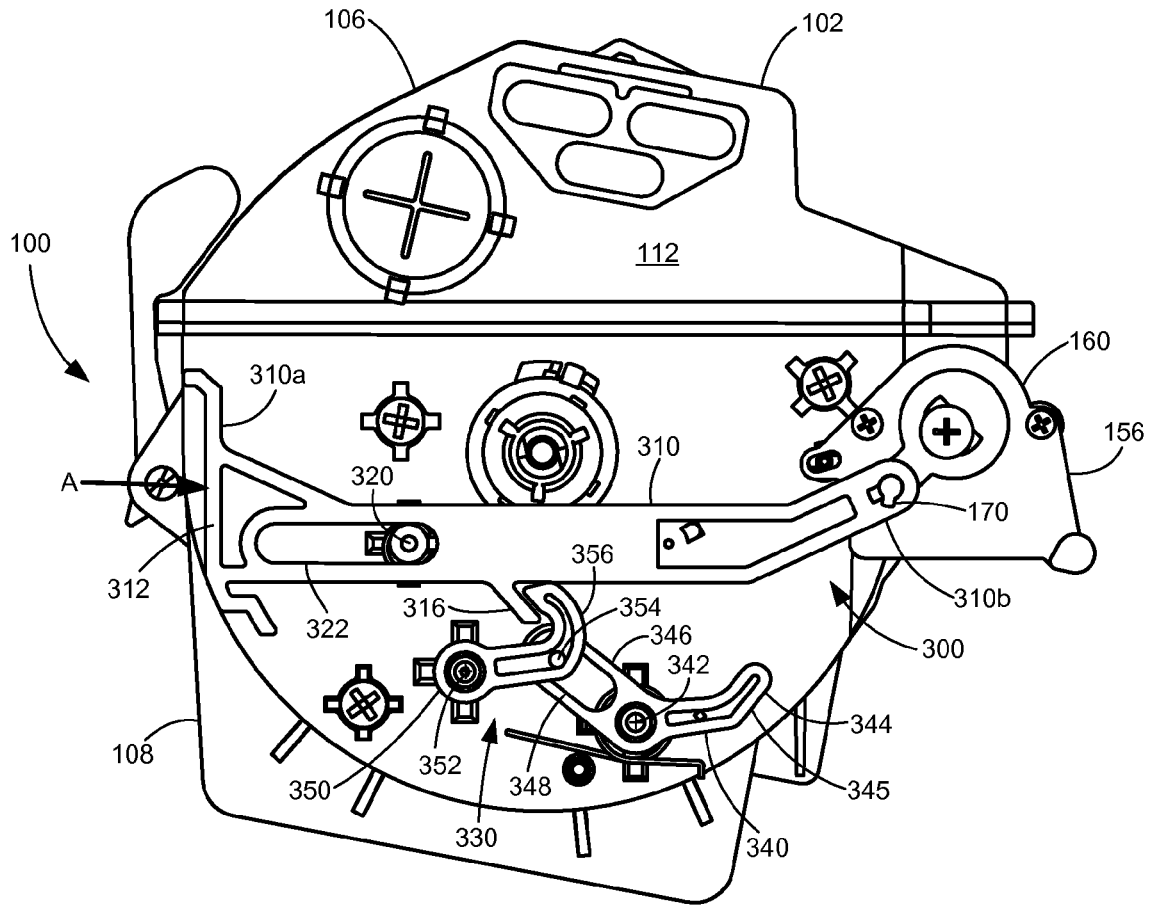
FIG. 14 is a side elevation view of a toner cartridge with an end cap removed to show a shutter lock mechanism in a locked position with a shutter closed according to a second example embodiment.

FIG. 14 shows a shutter lock mechanism 300 according to another example embodiment. End cap 120 is removed to more clearly illustrate shutter lock mechanism 300. Lock mechanism 300 includes a shutter linkage 310 that actuates lever 160 to open and close shutter 154 and an interlock 330 that prevents shutter 154 from opening unless toner cartridge 100 is installed within image forming device 22 and mated with imaging unit 180. At one end 310*a*, shutter linkage 310 includes an engagement surface 312, such as a button-like area, that is exposed to an exterior portion of housing 102, such as a rear portion of end cap 120 next to base 108 as shown. Shutter linkage 310 is connected at its opposite end 310*b* to lever 160. In the example embodiment illustrated, end 310*b* of shutter linkage 310 includes a channel 314 that receives a post 170 extending from lever 160. However, as discussed above, shutter linkage 310 and lever 160 may be connected by any suitable means. Shutter linkage 310 is an elongated member that extends from end 310*a* having engagement surface 312 to end 310*b* that is connected to lever 160. Shutter linkage 310 also includes a catch 316 extending therefrom that engages with interlock 330 when interlock 330 is in the locked position.

As discussed above, shutter linkage 310 is biased by one or more biasing members toward the exterior portion of housing 102 where end 310*a* is exposed to close shutter 154. Shutter linkage 310 is translatable in the direction shown by arrow A in FIG. 14 when engagement surface 312 is depressed and the biasing force is overcome. As shutter linkage 310 translates in the direction indicated by arrow A, lever 160 rotates opening shutter 154. Shutter linkage 310 includes an elongated slot 320 that receives a corresponding post 322 on end cap 120 or side wall 112. Slot 320 and post 322 define the path of movement of shutter linkage 310.

Interlock 330 is movable between a locked position and an unlocked position as discussed above. In the example embodiment illustrated, interlock 330 includes a pair of rotatable members 340, 350. Rotatable members 340, 350 are each pivotally mounted on side wall 112 at an axis of rotation 342, 352, respectively. Rotatable member 340 includes a first leg 344 and a second leg 346. First leg 344 includes an engagement surface 345 that contacts an engagement feature on imaging unit 180 to unlock interlock 330. Second leg 346 is connected to rotatable member 350 such that rotation of rotatable member 340 rotates rotatable member 350 to lock or unlock interlock 330. In the example embodiment illustrated, second leg 346 includes a channel 348 that receives a post 354 of rotatable member 350 such that post 354 is rotatable within channel 348. Of course, this configuration may be reversed so that rotatable member 340 includes a post and rotatable member 350 includes a corresponding channel. Rotatable member 350 also includes a hook 356 on an end thereof that engages with catch 316 of shutter linkage 310 when interlock 330 is in the locked position to prevent shutter linkage 310 from opening shutter 154. As discussed above, interlock 330 is biased by one or more biasing members in the locked position to prevent shutter 154 from opening prior to installation of toner cartridge 100 in image forming device 22.

As discussed above with respect to lock mechanism 200, shutter linkage 310 and interlock 330 prevent shutter 154 from being opened unless engagement surface 312 of shutter linkage 310 is depressed and engagement surface 345 of interlock 330 is engaged. In use, as toner cartridge 100 is inserted into image forming device 22 and mated with imaging unit 180, fin 190 on frame 186 (or another engagement feature on imaging unit 180) contacts engagement surface 345 of rotatable member 340. As discussed above, a slot, such as slot 174 shown in FIG. 13, may be provided in base 108 and/or end cap 120 of toner cartridge 100 to receive fin 190. With reference back to FIG. 14, the force from fin 190 on rotatable member 340 overcomes the biasing force applied to interlock 330 and causes rotatable member 340 to rotate in a counter-clockwise direction (as viewed in FIG. 14). This, in turn, rotates rotatable member 350 in a clockwise direction (as viewed in FIG. 14) thereby pulling hook 356 away from catch 316 of shutter linkage 310 and unlocking interlock 330. After toner cartridge 100 is inserted into image forming device 22, when an access door to image forming device 22 is closed, a plunger or other projection extending from an inner surface of the access door (or otherwise linked to the access door) presses engagement surface 312 overcoming the biasing force applied to shutter linkage 310 and depressing shutter linkage 310 causing lever 160 to rotate to open shutter 154. As discussed above, when toner cartridge 100 is removed from image forming device 22, this sequence is reversed to ensure that shutter 154 remains closed while toner cartridge 100 is removed from image forming device 22.

Accordingly, it will be appreciated that a locking mechanism, such as locking mechanisms 200 and 300, having a shutter linkage and an interlock may be employed to ensure that shutter 154 remains closed unless toner cartridge 100 is installed in image forming device 22 and mated with imaging unit 180. However, a problem may arise when locking mechanisms 200 and 300 are used if toner cartridge 100 is installed in image forming device 22 without imaging unit 180. In this situation, if the user tries to close the access door to image forming device 22, he or she will be unable to because interlock 230, 330 will prevent shutter linkage 210, 310 from moving. If the user persists in trying to close the access door, depending on the force applied, it is possible that one or more of the components making up locking mechanism 200, 300 or another portion of toner cartridge 100 or image forming device 22 could break.

Figure 15:
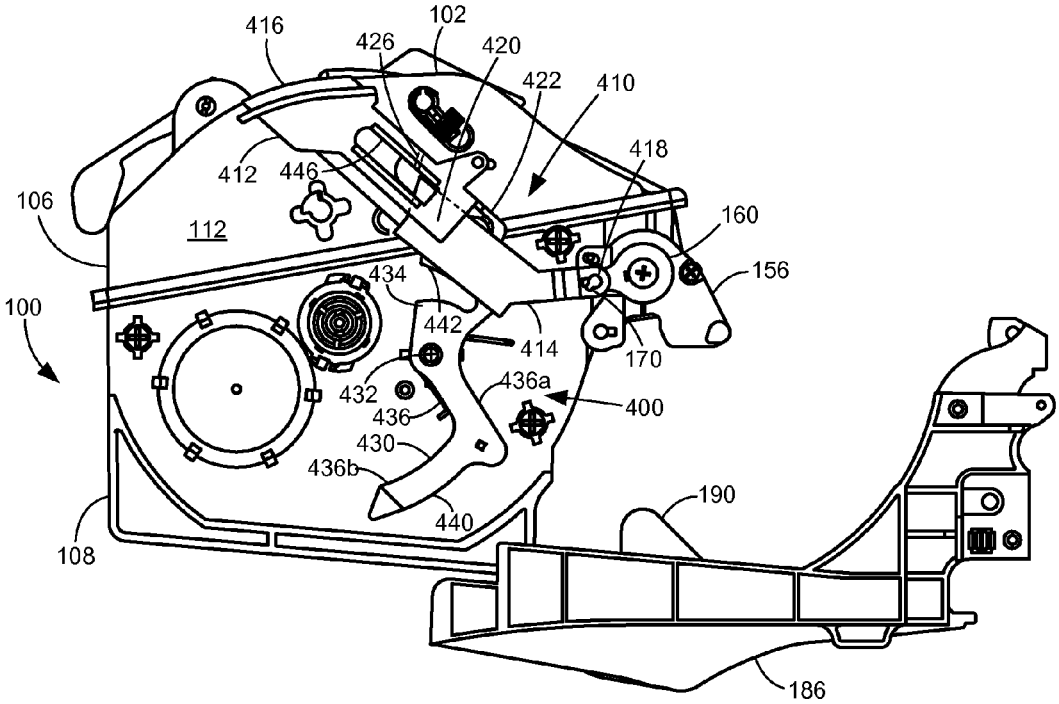
FIG. 15 is a side elevation view of a toner cartridge with an end cap removed to show a shutter lock mechanism in a locked position with a shutter closed according to a third example embodiment.

With reference to FIG. 15, a shutter lock mechanism 400 that addresses this problem is shown according to one example embodiment. End cap 120 is once again removed to more clearly illustrate shutter lock mechanism 400. Shutter lock mechanism 400 includes a shutter linkage 410 that actuates lever 160 to open and close shutter 154 and an interlock 430 that prevents shutter 154 from opening unless toner cartridge 100 is installed within image forming device 22 and mated with imaging unit 180. In this embodiment, shutter linkage 410 includes an outer linkage 412 and an inner linkage 414. Outer linkage 412, in one form, is forked having outer and inner side walls 420, 422, respectively, and includes an engagement surface 416, such as a button-like area, that is exposed to an exterior portion of housing 102, such as a rear portion of end cap 120 next to lid 106 as shown. Inner linkage 414 is connected at one end to lever 160. In the example embodiment illustrated, inner linkage includes a channel 418 that receives post 170 extending from lever 160; however, as discussed above, this connection may be established by any suitable means. Inner linkage 414 is pivotable about post 170 of lever 160. Outer linkage 412 and inner linkage 414 are elongated members that overlap with one another. In the embodiment illustrated, inner linkage 414 is positioned in the fork between side walls 420, 422 of outer linkage 412; however, this configuration may be reversed as desired. Outer linkage 412 is biased by a suitable biasing member toward the exterior portion of housing 102 where engagement surface 416 is exposed. Similarly, inner linkage 414 is biased by a biasing member away from lever 160 so that shutter 154 is biased toward the closed position.

In this embodiment, interlock 430 is pivotally attached to side wall 112 at its axis of rotation 432. Interlock 430 includes a first leg 434 and a second leg 436 that each extend radially from axis of rotation 432. Second leg 436 includes a first portion **436*a* that extends radially from axis of rotation 432 and a second portion 436*b* that extends in a curved manner near the distal end of first portion 436*a* at an angle that is roughly perpendicular to first portion 436*a*. Second portion 436*b* of second leg 436 includes an engagement surface 440 that contacts an engagement feature, such as fin 190, on imaging unit 180 to permit shutter 154 to open. First leg 434 includes a flexible member 442 at a distal end thereof. Flexible member 442 includes a curved engagement surface 444 (FIG. 18) on an outer surface thereof facing inner linkage 414. A bottom surface of inner linkage 414 (hidden behind the side wall of inner linkage 414) is supported by flexible member 442 on engagement surface 444. Interlock 430 is biased by one or more biasing members in the locked position shown in FIG. 15 to prevent shutter 154 from opening prior to installation of toner cartridge 100 in image forming device 22**.

Figure 16:
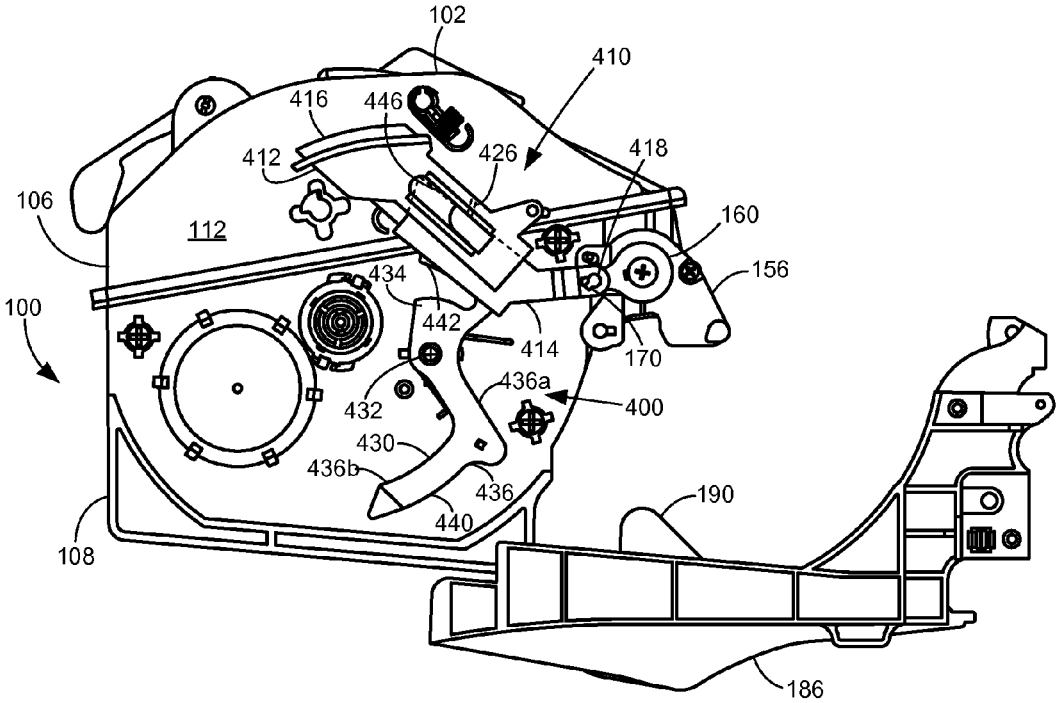
FIG. 16 is a side elevation view of the toner cartridge shown in FIG. 15 showing the shutter lock mechanism in the locked position permitting an outer linkage to be depressed without opening the shutter.
Figure 17:
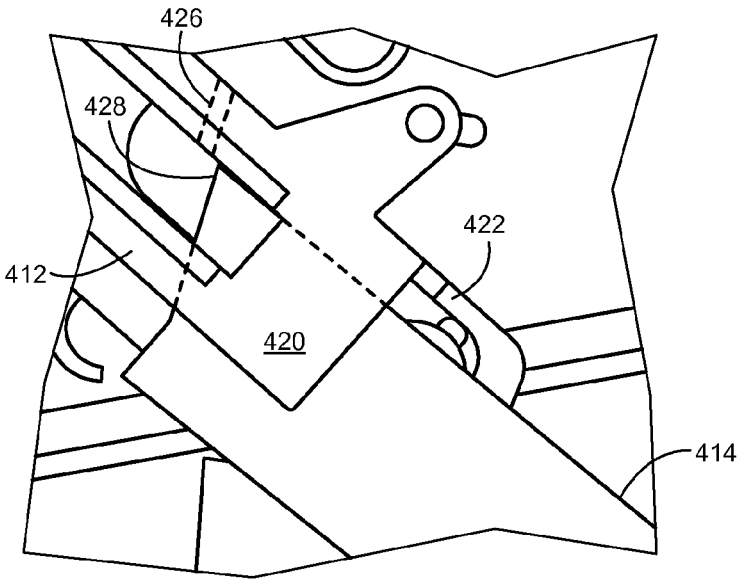
FIG. 17 is a close up view of the toner cartridge shown in FIGS. 15 and 16 when the shutter lock mechanism is in the locked position showing an inner linkage spaced below a catch on the outer linkage to permit the outer linkage to be depressed without opening the shutter.

In this embodiment, if engagement surface 416 is pressed while interlock 430 is in the locked position as shown in FIG. 16, outer linkage 412 is depressed toward and past inner linkage 414. As shown in closer detail in FIG. 17, when interlock 430 is locked, inner linkage 414 is spaced below a catch 426 on the inner top surface of outer linkage 412. As a result, outer linkage 412 is free to pass inner linkage 414 without depressing it and, therefore, without opening shutter 154. Accordingly, lock mechanism 400 allows the user to close the access door to image forming device 22 without opening shutter 154 if imaging unit 180 is not present. The user is also able to press engagement surface 416 without opening shutter 154.

Figure 18:
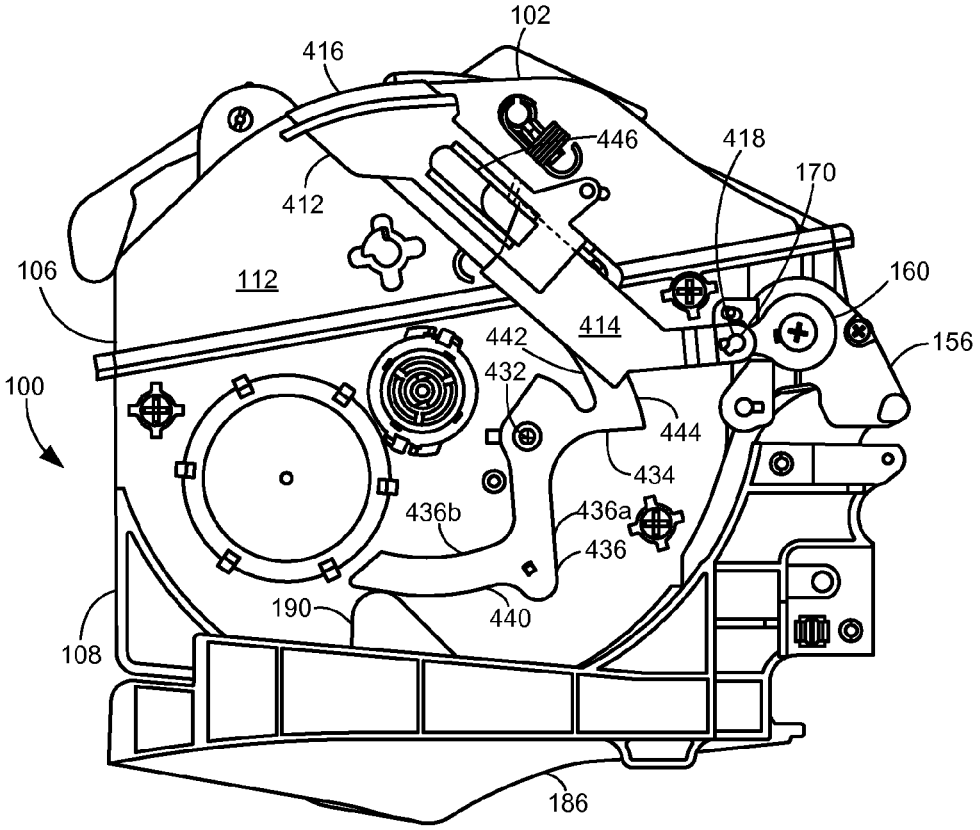
FIG. 18 is a side elevation view of the toner cartridge shown in FIGS. 15-17 showing the shutter lock mechanism in an unlocked position with the shutter closed.
Figure 19:
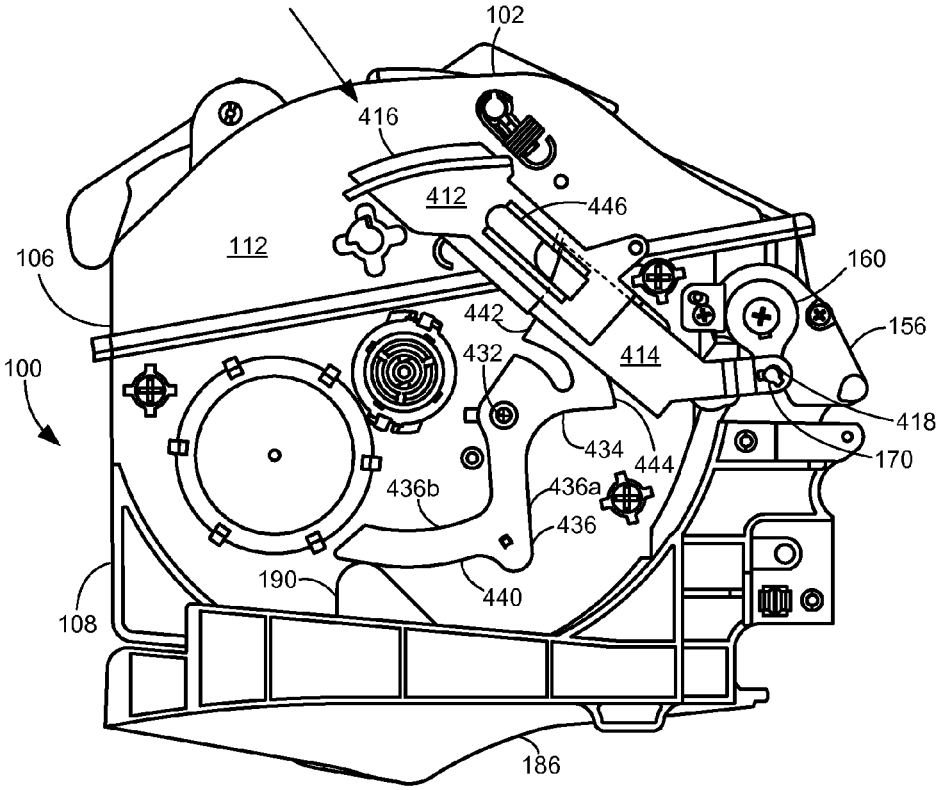
FIG. 19 is a side elevation view of the toner cartridge shown in FIGS. 15-18 showing the shutter lock mechanism in an unlocked position with the shutter opened.
Figure 20:
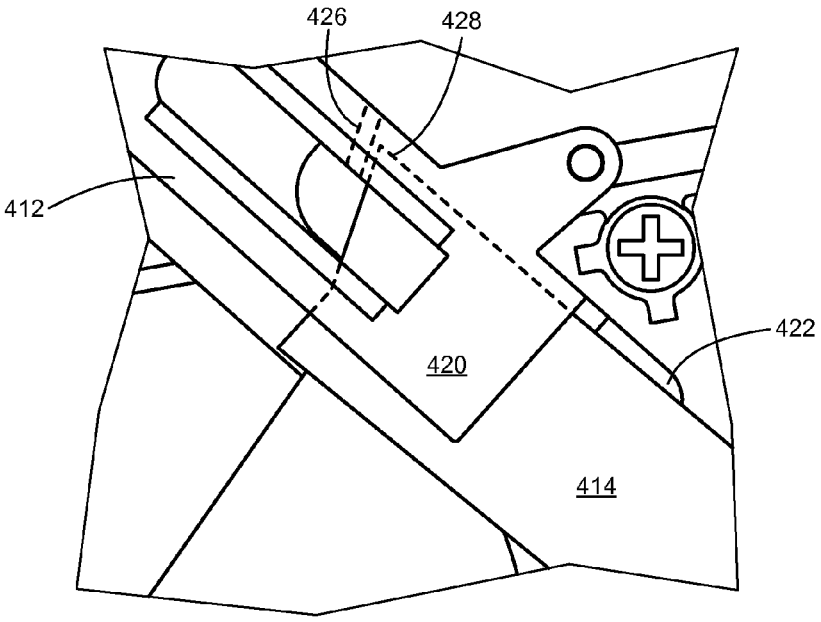
FIG. 20 is a close up view of the toner cartridge shown in FIGS. 15-19 when the shutter lock mechanism is in the unlocked position showing the inner linkage in the path of the catch on the outer linkage to permit the inner linkage to open the shutter when the outer linkage is depressed.

With reference to FIG. 18, when toner cartridge 100 is inserted into image forming device 22 and mated with imaging unit 180, fin 190 on frame 186 (or another engagement feature on imaging unit 180) contacts engagement surface 440 of interlock 430. The force from fin 190 on interlock 430 overcomes the biasing force applied to interlock 430 and causes it to rotate in a clockwise direction (as viewed in FIG. 18) to the unlocked position, in turn, raising inner linkage 414. As discussed above, a slot, such as slot 174 shown in FIG. 13, may be provided in base 108 and/or end cap 120 of toner cartridge 100 to receive fin 190. With reference back to FIG. 18, after toner cartridge 100 is inserted into image forming device 22, when an access door to image forming device 22 is closed, a plunger or other projection extending from an inner surface of the access door (or otherwise linked to the access door) presses engagement surface 416 overcoming the biasing force applied to outer linkage 412 and depressing both outer linkage 412 and inner linkage 414 causing lever 160 to rotate to open shutter 154 as shown in FIG. 19. When engagement surface 416 is pressed, outer linkage 412 translates in the direction shown by the arrow in FIG. 19. Outer linkage 412 includes an elongated slot 446 that receives a corresponding post on end cap 120 or side wall 112. Slot 446 defines the path of movement of outer linkage 412. As shown in closer detail in FIG. 20, when interlock 430 is in the unlocked position, rotated by fin 190, inner linkage 414 is raised into the path of catch 426. As a result, when outer linkage 412 is depressed, catch 426 engages a top corner 428 of inner linkage 414 overcoming the bias applied to inner linkage 414 and causing inner linkage 414 to advance with outer linkage 412 which, in turn, opens shutter 154. When outer linkage 412 and inner linkage 414 are depressed, the motion of inner linkage 414 is not strictly translative; rather, inner linkage 414 dips downward and then rises slightly as lever 160 rotates about the axis of rotation of shutter 154. Flexible member 442 accommodates this down-and-up motion by flexing slightly to allow inner linkage 414 to dip without binding or restring its motion. This helps keep outer linkage 412 and inner linkage 414 engaged with each other.

When toner cartridge 100 is removed from image forming device 22, this sequence is reversed. When the access door to image forming device 22 is opened, outer linkage 412 and inner linkage 414 retract to their biased positions, closing shutter 154. As the user removes toner cartridge 100 from the device, fin 190 disengages from engagement surface 440 causing interlock 430 to rotate in a counter-clockwise direction (as viewed in FIGS. 15, 16, 18 and 19). As interlock 430 rotates, inner linkage 414 lowers until top corner 428 is below the path of catch 426. As a result, shutter 154 will remain closed while toner cartridge 100 is removed from image forming device 22 even if engagement surface 416 is pressed.

Figure 21:
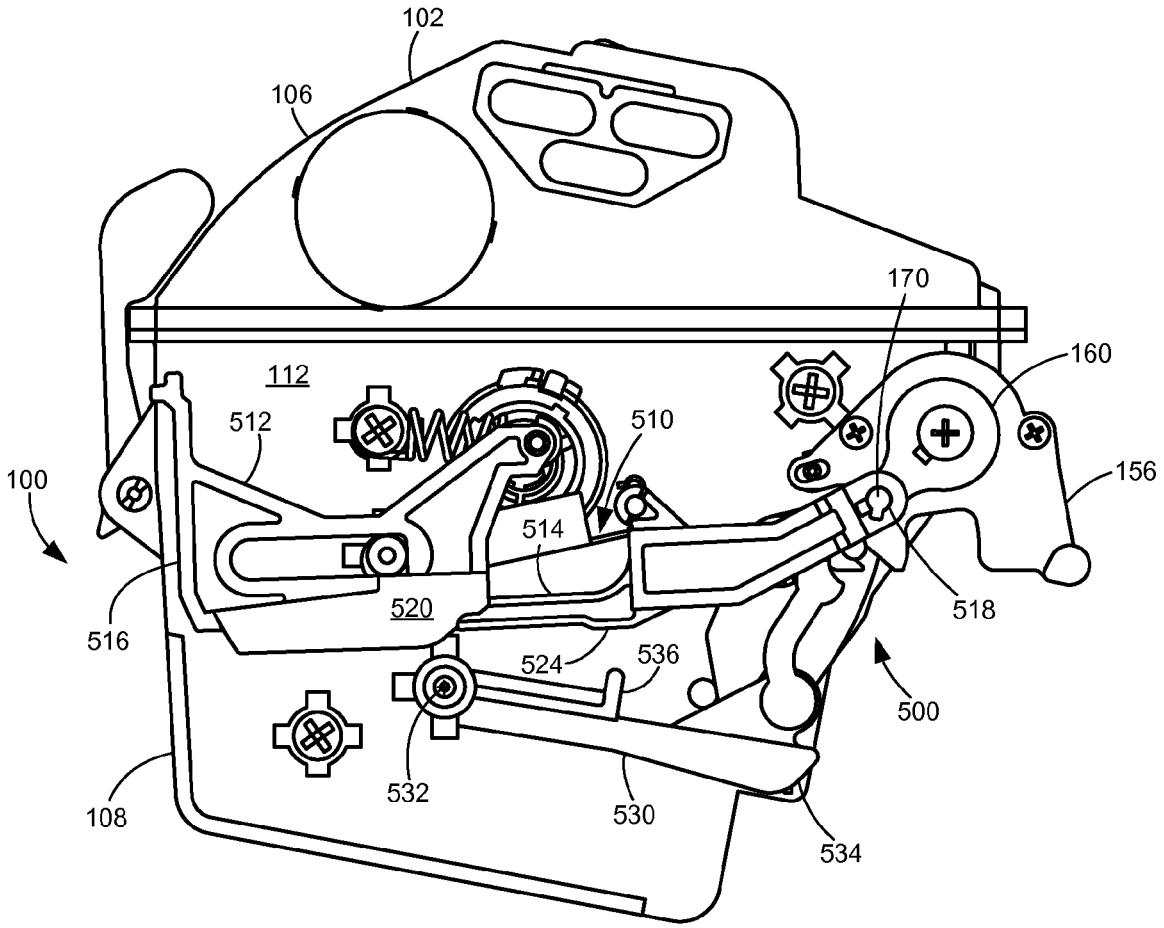
FIG. 21 is a side elevation view of a toner cartridge with an end cap removed to show a shutter lock mechanism in a locked position with a shutter closed according to a fourth example embodiment.

FIG. 21 shows a shutter lock mechanism 500 according to another example embodiment. End cap 120 is removed to more clearly illustrate shutter lock mechanism 500. Shutter lock mechanism 500 includes a shutter linkage 510 that actuates lever 160 to open and close shutter 154 and an interlock 530 that prevents shutter 154 from opening unless toner cartridge 100 is installed within image forming device 22 and mated with imaging unit 180. In this embodiment, shutter linkage 510 includes an outer linkage 512 and an inner linkage 514. Outer linkage 512, in one form, is forked having an outer side wall 520 and an inner side wall (hidden behind outer side wall 520). Outer linkage 512 includes an engagement surface 516, such as a button-like area, that is exposed to an exterior portion of housing 102, such as a rear portion of end cap 120 next to base 108 as shown. Inner linkage 514 is connected at one end to lever 160. In the example embodiment illustrated, inner linkage includes a channel 518 that receives a post 170 extending from lever 160; however, as discussed above, this connection may be established by any suitable means. Outer linkage 512 and inner linkage 514 are elongated members that overlap with one another. In the embodiment illustrated, inner linkage 514 is positioned in the fork between outer side wall 520 and the inner side wall of outer linkage 512; however, this configuration may be reversed as desired. Outer linkage 512 is biased by a suitable biasing member toward the exterior portion of housing 102 where engagement surface 516 is exposed. Similarly, inner linkage 514 is biased by a biasing member away from lever 160 so that shutter 154 is biased toward the closed position. As discussed above with respect to outer linkage 412 and inner linkage 414 shown in FIGS. 15-20, an inner surface of outer linkage 512 includes a catch that engages a portion of inner linkage 514 when interlock 530 is unlocked but clears inner linkage 514 when interlock 530 is locked.

In this embodiment, interlock 530 is pivotally attached to side wall 112 at its axis of rotation 532. Interlock 530 extends along side wall 112 from its attachment point 532 toward front wall 114. Interlock 530 includes a curved or ramped engagement surface 534 that contacts an engagement feature, such as fin 190, on imaging unit 180 to permit shutter 154 to open. Interlock 530 also includes an upward extending post 536 that raises inner linkage 514 when interlock 530 is unlocked as discussed below. Interlock 530 is biased by one or more biasing members in the locked position shown in FIG. 21 to prevent shutter 154 from opening prior to installation of toner cartridge 100 in image forming device 22.

As discussed above, if engagement surface 516 is pressed while interlock 530 is in the locked position, outer linkage 512 travels past inner linkage 514 without depressing inner linkage 514. As a result, shutter 154 does not open. This allows the user to close the access door to image forming device 22 when imaging unit 180 is not present or press engagement surface 516 without opening shutter 154.

When toner cartridge 100 is inserted into image forming device 22 and mated with imaging unit 180, an engagement feature on imaging unit 180, such as fin 190, contacts engagement surface 534 of interlock 530. The force from the engagement feature on interlock 530 overcomes the biasing force applied to interlock 530 and causes it to rotate in a counter-clockwise direction (as viewed in FIG. 21) to the unlocked position. The counter-clockwise rotation of interlock 530 causes post 536 to contact a bottom portion 524 of inner linkage 514 and raise inner linkage 514 into the path of the catch on outer linkage 512 as discussed above. A slot, such as slot 174 shown in FIG. 13, may be provided in base 108 and/or end cap 120 of toner cartridge 100 to receive the engagement feature. After toner cartridge 100 is inserted into image forming device 22, when an access door to image forming device 22 is closed, a plunger or other projection extending from an inner surface of the access door (or otherwise linked to the access door) presses engagement surface 516 overcoming the biasing force applied to outer linkage 512 and depressing both outer linkage 512 and inner linkage 514 causing lever 160 to rotate to open shutter 154.

When toner cartridge 100 is removed from image forming device 22, this sequence is reversed. When the access door to image forming device 22 is opened, outer linkage 512 and inner linkage 514 retract to their biased positions, closing shutter 154. As the user removes toner cartridge 100 from the device, the engagement feature on imaging device 180 disengages from engagement surface 534 causing interlock 530 to rotate in a clockwise direction (as viewed in FIG. 21). As interlock 530 rotates, inner linkage 514 lowers until it clears the path of the catch on outer linkage 512. As a result, shutter 154 will remain closed while toner cartridge 100 is removed from image forming device 22 even if engagement surface 516 is pressed.

Accordingly, it will be appreciated that a locking mechanism, such as locking mechanisms 400 and 500, having a shutter linkage and an interlock may be employed to ensure that shutter 154 remains closed unless toner cartridge 100 is installed in image forming device 22 and mated with imaging unit 180. Further, the use of an outer linkage that is capable of sliding past an inner linkage when the interlock is locked allows the user to close the access door to image forming device 22 when imaging unit 180 is not present without opening shutter 154 or damaging image forming device 22 or toner cartridge 100. The user is also able to press the engagement surface of the shutter linkage, such as engagement surface 416 or 516, without opening shutter 154.

The foregoing description of several embodiments has been presented for purposes of illustration. It is not intended to be exhaustive or to limit the application to the precise forms disclosed, and obviously many modifications and variations are possible in light of the above teaching. It is understood that the invention may be practiced in ways other than as specifically set forth herein without departing from the scope of the invention. It is intended that the scope of the application be defined by the claims appended hereto.

The invention claimed is:

1. A toner cartridge for use in an image forming device, comprising:

a housing having a reservoir for containing toner therein, the housing having an exit port on a front portion of the housing in fluid communication with the reservoir;

a shutter positioned at the exit port that is movable between an open position to permit toner from the reservoir to pass out of the exit port and a closed position to prevent toner from passing out of the exit port, the shutter being biased toward the closed position;

a first linkage member operatively connected to the shutter to open the shutter upon being actuated by a first engagement feature in the image forming device, the first linkage member having a first engagement surface positioned on a rear portion of the housing to contact the first engagement feature to open the shutter;

a second linkage member pivotally attached to a side wall of the housing and biased toward a home position, the second linkage member having a second engagement surface positioned on the front portion of the housing to contact a second engagement feature to pivot the second linkage member away from the home position; and a third linkage member movable with the second linkage member, wherein when the second linkage member is in the home position, the third linkage member is in a blocking position preventing the first linkage member from opening the shutter and when the second linkage member pivots away from the home position, the third linkage member moves to a non-blocking position permitting the first linkage member to open the shutter upon being actuated by the first engagement feature.

2. The toner cartridge of claim 1, further comprising a catch on the first linkage member that engages with the third linkage member when the first linkage member is actuated by the first engagement feature and the third linkage member is in the blocking position.

3. The toner cartridge of claim 2, wherein the catch extends from a bottom portion of the first linkage member.

4. The toner cartridge of claim 2, further comprising a knob extending from the third linkage member positioned in a path of movement of the catch of the first linkage member when the third linkage member is in the blocking position.

5. The toner cartridge of claim 1, wherein the first engagement surface is positioned on a first end of the first linkage member and a second end of the first linkage member is operatively connected to the shutter through a lever.

6. The toner cartridge of claim 1, further comprising a slot in the front portion of the housing that allows the second engagement feature to contact the second engagement surface as the toner cartridge is inserted in the image forming device.

* * * * *